United States Patent [19]

Moser

[11] Patent Number: 4,924,953

[45] Date of Patent: May 15, 1990

[54] ROCK DRILL

[75] Inventor: Bernhard Moser, Altshausen, Fed. Rep. of Germany

[73] Assignee: Hawera Probst GmbH & Co., Ravensburg, Fed. Rep. of Germany

[21] Appl. No.: 341,206

[22] Filed: Apr. 21, 1989

[30] Foreign Application Priority Data

Apr. 23, 1988 [DE] Fed. Rep. of Germany ..... 3813849

[51] Int. Cl.[5] ..... E21B 17/22; E21B 10/44; E21B 10/40

[52] U.S. Cl. ..... 175/323; 175/394; 175/395; 408/226; 408/230

[58] Field of Search ..... 175/323, 394, 395, 386, 175/389; 408/230, 226, 210; 198/676, 677

[56] References Cited

U.S. PATENT DOCUMENTS

| | | | |
|---|---|---|---|
| 2,322,894 | 6/1943 | Stevens | 408/230 |
| 3,190,377 | 6/1965 | Rassieur | 175/323 X |
| 3,749,189 | 7/1973 | Boehm | 175/394 |
| 4,294,319 | 10/1981 | Guergen | 175/389 |
| 4,549,616 | 10/1985 | Rumpp et al. | 175/323 X |
| 4,579,180 | 4/1986 | Peetz et al. | 175/394 |
| 4,699,226 | 10/1987 | Müller et al. | 175/323 |

FOREIGN PATENT DOCUMENTS

| | | | |
|---|---|---|---|
| 2041985 | 6/1971 | Fed. Rep. of Germany . | |
| 2013327 | 12/1971 | Fed. Rep. of Germany . | |
| 2403722 | 8/1974 | Fed. Rep. of Germany . | |
| 3317989 | 11/1984 | Fed. Rep. of Germany . | |
| 3830972 | 3/1989 | Fed. Rep. of Germany . | |
| 147785 | 4/1981 | German Democratic Rep. . | |
| 518747 | 3/1940 | United Kingdom | 175/386 |
| 2088437 | 6/1982 | United Kingdom . | |

*Primary Examiner*—Hoang C. Dang

*Attorney, Agent, or Firm*—Spencer & Frank

[57] ABSTRACT

A rock drill for rotary and/or percussive stress, in particular for use in percussion or hammer drilling machines, is proposed, which by its geometrical design makes improved efficiency and simplified production possible. For this purpose, the feed spiral 5 is designed alternately with horizontal feed sections 8,8' with a 0° pitch, and adjoining lead sections 9,9', the respective feed sections assuming an angle of rotation of 90° on the drilling tool.

9 Claims, 2 Drawing Sheets

ROCK DRILL

BACKGROUND OF THE INVENTION

The invention relates to a rock drill for rotary and/or percussion stress, in particular for percussion or hammer drilling machines.

The production of feed spirals on rock drills usually takes place by milling or whirling. Special forging processes for the production of the drill have also become known. In the case of all processes, the single or double thread feed spiral runs uniformly around the drill shank to the drill head, the spiral pitch being variable, if appropriate, over the length of the feed spiral.

It has become known from German Patent Specification 2,013,327 to design the feed spiral not smooth but staircase-shaped in order to prevent the drilling dust present in the feed spiral slipping due to feed sections with a slight pitch on the feed spiral. In this case, during percussion drilling, the combined rotary and axial movement of the drilling tool is utilised, the drilling tool spinning underneath the drilling dust after axial movement and the associated raising of the said dust, and the raised particles dropping onto the next higher staircase section. The intention of this is to achieve an improved feed without a tendency to clog, it being possible to increase the pitch angle and thus the feed rate.

SUMMARY OF THE INVENTION

The invention is based on the object of creating a drilling tool, in particular a rock drill for use in percussion or hammer drilling machines, in which the feed spiral can be produced easily due to its design and which produces better results in its feed rate than conventionally designed drilling tools.

Starting from a rock drill of the type referred to at the beginning, this object is achieved according to the invention by the provision of a drill spiral having first and second sections offset by 90° in the direction of rotation of the drill, the first sections having a pitch of zero degrees and the second sections having a pitch which is greater than zero degrees.

The rock drill according to the invention is based on the realisation that it is not necessary for a satisfactory drilling dust feed to design the complete feed spiral staircase-shaped or step-shaped with feed sections of flatter pitch. Rather, it suffices if the drilling dust is loosened from time to time along its path over the feed spiral by a rather stronger axial percussive component, in order that a caking of the drilling dust and thus a tendency to clog is avoided. For this purpose, the invention proposes that the feed spiral includes alternately following horizontal feed sections with a 0° pitch and lead sections, the sections in each case encompassing a 90° angle of rotation. Along a lead or pitch, therefore, a first horizontal feed section is followed by a first rising feed section, which is adjoined by a second horizontal feed section and this in turn is adjoined by a second rising feed section. Therefore, with an angle of rotation of 360°, two horizontal and two rising feed sections are provided with one pitch of the spiral. In this arrangement, the horizontal feed sections serve for the loosening brought about by an axial acceleration and the rising feed sections serve for the drilling dust feed itself.

If a feed spiral is divided up into feed sections alternating in this way, this gives rise to a further feature essential for the invention that the feed spiral does not have any undercuts in side view on the horizontal feed sections. This makes it possible to produce the feed spiral in a simple procedure by forging, in particular drop forging with a two-part forging die. The two-part forging die is designed as a ram-shaped die and the forging operation can take place without a rotational movement of the feed spiral. This is preferably achieved whenever the surface tangents of the horizontal feed section run perpendicular to the vertical plane through the horizontal feed section, i.e. whenever there are no undercuts in this feed section. As a result, an extremely inexpensive production process is obtained, even for heavy, solid drilling tools for use in heavy-duty hammer drilling machines.

Consequently, what is decisive for easy production of the feed spiral from a forged base material is the geometrical shape with straight feed sections without undercuts.

The design of the rock drill according to the invention with a double thread feed spiral is particularly advantageous, the horizontal feed sections which are opposite in each case, being formed by horizontal ring segments. The ring segments themselves serve for good guidance of the drilling tool in the drilling hole, since an optimum lateral support of the drill is ensured by the ring segments over the entire drilling length. The ring segments are interrupted by the flanks, in each case obliquely rising, of the rising feed sections.

It goes without saying that the invention may also take the form of a single thread feed spiral. A double threaded feed spiral is advantageous in the case of a drilling tool with a step drill head with center point (holing-through drill), due to the double drilling dust discharge at the drill head.

In an advantageous embodiment as a holing-through drill, the rock drill according to the invention is therefore equipped with a double thread feed spiral with a correspondingly designed drill head. Since such a drill head is itself generally designed as circular-cylindrical with a center point on top and metal carbide cutting elements arranged at the sides, this drill head is joined by two semicircular incisions to the double thread feed spiral.

In a special embodiment of the invention, the rising feed sections may be provided additionally with staircase-shaped flanks, as described in the patent referred to at the beginning.

Further details essential for the invention are described in the following description with reference to an exemplary embodiment.

DETAILED DESCRIPTION OF THE PREFERRED EMBODIMENT

Figure 1:
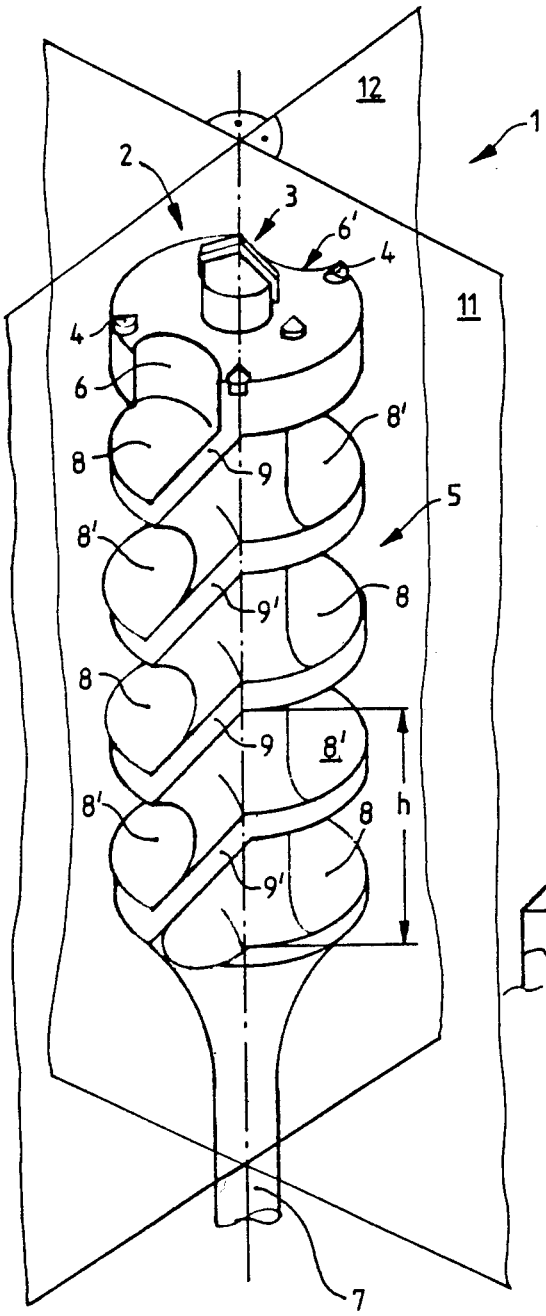
FIG. 1 shows a perspective view of a rock drill according to the invention.

The rock drill 1 represented in FIG. 1 is designed as a holing-through drill with a correspondingly designed drill head 2 with a center point 3 and metal carbide cutting elements 4. The double thread feed spiral 5 is joined by semicircular incisions 6 as drilling dust groove to the drill head 2. The drill shank 7 adjoins in the lower region of the drill spiral 5.

Figure 2:
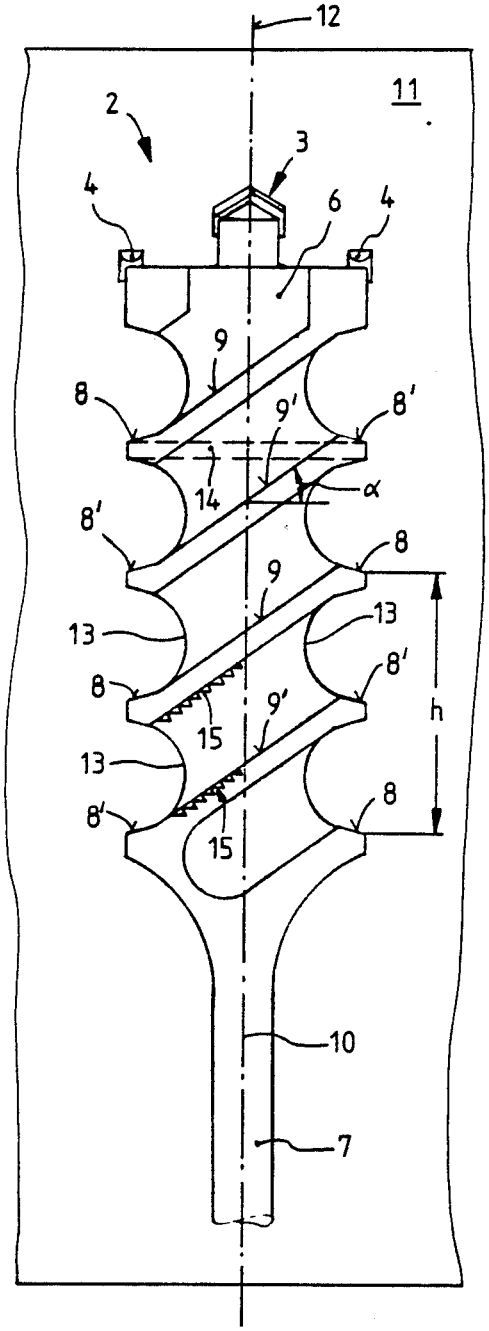
FIG. 2 shows a side view of the ring segment-like horizontal feed sections with rising feed sections in between, FIG. 3 shows a side view of the representation according to FIG. 2.
Figure 3:
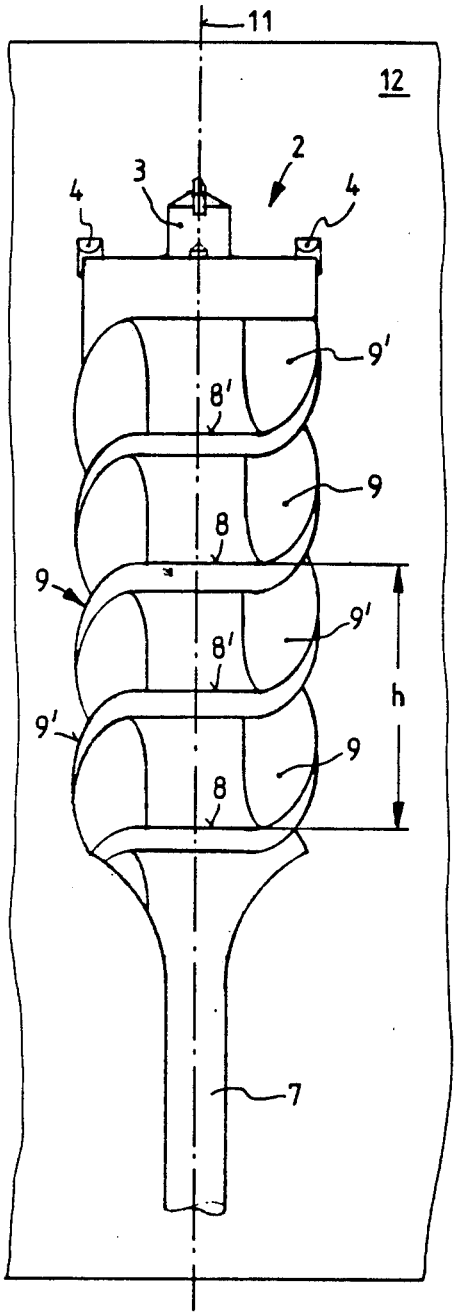

As revealed by FIG. 1 in perspective view and by FIGS. 2 and 3 in the respective side view, the feed spiral 5 consists of alternating horizontal feed sections 8,8' with a 0° pitch and feed sections 9,9' which are designed as rising feed sections, individual feed sections adjoining one another at an angle of rotation of 90°. The pitch $\alpha$ of the rising feed sections is denoted by $\alpha$, where $\alpha$=20°-60°, and is preferably 45°. In this arrangement, the first spiral has the feed sections 8,9 and the second feed spiral has the feed sections 8',9'. Each helical feed spiral consequently has within a pitch h two horizontally running feed sections 8 and 8' and two rising feed sections 9 and 9' in between.

The feed spiral of the drill according to the invention is also characterised by the feed spiral having no undercuts in the horizontal feed sections 8. To describe this situation, the first vertical plane 11 running parallel to the plane of the page in FIG. 2 and through the longitudinal axis 10 of the drill, or a second vertical plane 12 perpendicular to the first and likewise running through the longitudinal axis 10 of the drill is used. The first vertical plane 11 is perpendicular to the plane of the page in FIG. 3, passes through the longitudinal axis 10 of the drill and halves the horizontal feed section 8,8'. These two vertical planes 11, 12 are likewise drawn in diagrammatically in FIG. 1.

Each horizontal feed section 8 or 8' is halved by the first vertical plane 11 (see FIG. 3) and each surface tangent in the drilling dust groove of the horizontal feed section 8 or 8' is in each case perpendicular to the first vertical plane 11 and to the second vertical plane 12. In the representation of the feed spiral according to FIG. 2, consequently the horizontal feed sections 8,8' can be produced with a two-part forging die which runs perpendicular to the plane of the page. This is a consequence of the horizontal feed section 8,8', including the arcuate transitions 13 between the individual feed sections 8,8' having no undercuts.

As indicated in FIG. 2 in the upper region, in the case of a double thread feed spiral, two laterally opposite horizontal feed sections 8,8' are in each case formed by horizontal ring disk-shaped segments 14, which are interrupted in each case by a rising feed section 9,9'.

In the case of the rising feed sections 9,9' as well, all surface tangents may run parallel to the first vertical plane 11; however, in terms of tool engineering, this is not absolutely necessary in forging, i.e. these feed sections may also be of profiled design. With respect to the second vertical plane 12, the surface tangents run at the angle of rise of the rising feed spiral section 9 and 9'.

In a preferred embodiment, the rising feed sections 9 and 9' may have a staircase-shaped course 15, as mentioned in the patent described at the beginning. As a result, the loosening of the drilling dust is brought about by a vertical impact component also on the rising feed section in addition to the horizontal feed section.

Figure 4:
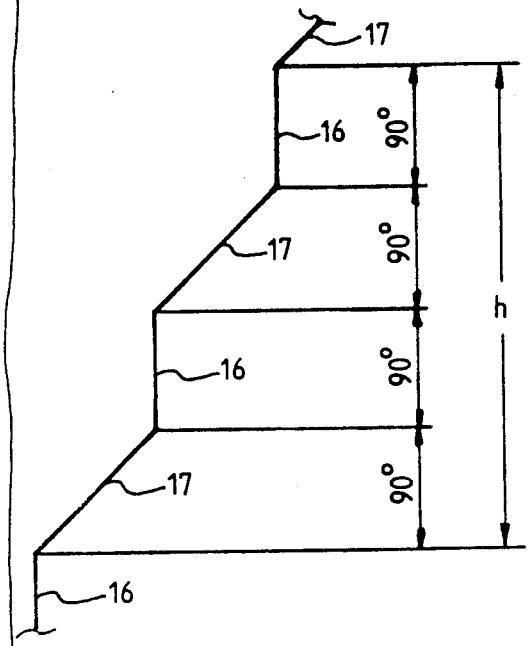
FIG. 4 shows a diagrammatic representation of the feed sections.

In FIG. 4, the operating principle of the rock drill according to the invention is represented diagrammatically.

The drilling dust generated in the drilling hole passes via the two incisions 6 and 6' via the first rising feed section 9 (9' concealed in FIG. 1) to the first horizontal feed sections 8 and 8', respectively. In these horizontal feed sections 8, 8', as represented in FIG. 4 as a vertical line 16, no feed takes place during an angle of rotation of 90° but only a loosening of the drilling dust due to the vertical percussive movements of the drill. Once the drilling dust has covered an angle of rotation of 90°, it comes to rest in the rising feed sections 9 or 9' and is transported along this feed flank in the direction of the drill shank 7. This axial feeding operation is identified in FIG. 4 by reference numeral 17. After a further transport of the drilling dust over an angle of rotation of 90°, the rising feed section 9,9' is followed in turn by a horizontal feed section 8,8' with a 0° pitch for the loosening of the drilling dust over a transport angle of 90°. Thereafter there finally follows a rising feed section 9,9' with a corresponding feeding operation. The diagrammatic course represented in FIG. 4 over the feed sections 8, 8' is consequently followed over a lead or pitch h. In FIG. 4, the pitch h is represented on an enlarged scale in comparison with the representation in FIGS. 1 to 3. The angles of 90° indicated in FIG. 4 relate to a rotational movement or a transporting movement of the drilling dust along the feed sections by an angle of rotation of 90°.

The invention is not restricted to the exemplary embodiment described and represented. Rather, it also comprises all further developments and refinements accomplished by a person skilled in the art without inventive content of their own.

I claim:

1. A rock drill for producing percussive stress for use in drilling machines, comprising:

a solid shank having a feed spiral and a longitudinal axis, said feed spiral having horizontal feed sections with a pitch of 0° alternating with lead sections, said horizontal feed sections each extending about said longitudinal axis of said solid shank through an angle of approximately 90° and said lead sections extending about said longitudinal axis of said solid shank through an angle of approximately 90°.

2. The rock drill as claimed in claim 1, wherein each said horizontal feed section has a surface having a surface tangent which is perpendicular to a vertical plane containing said longitudinal axis and which bisects said horizontal feed section.

3. The rock drill as claimed in claim 1, wherein said solid shank includes another said feed spiral which is disposed such that two laterally opposite horizontal feed sections, each being disposed on a different one of said feed-spirals, are in a plane which is orthogonal to said longitudinal axis, each of said two laterally opposite horizontal feed sections being respectively formed by disk-shaped segments.

4. The rock drill as claimed in claim 3, wherein the pitch $\alpha$ of each said lead section is in a range of 20° to 60°.

5. The rock drill as claimed in claim 1, wherein said feed spiral is formed of a forged base material, each of said horizontal feed sections being generally planar and substantially without undercuts.

6. The rock drill as claimed in claim 1, wherein said drill head is adapted for use as a step drill head and includes a center point and at least one hard metal tip, said drill head including a semicircular recess open to a surface of one of said lead sections in drill head.

7. The rock drill as claimed in claim 1, wherein said lead sections include staircase-shaped flank surfaces.

8. The rock drill as claimed in claim 1, wherein said feed spiral is a single thread feed spiral.

9. The rock drill as claimed in claim 3, wherein the pitch $\alpha$ of each said lead section is approximately equal to 45°.

* * * * *